US005839416A

United States Patent [19]

Kruiswyk et al.

[11] Patent Number: 5,839,416

[45] Date of Patent: Nov. 24, 1998

[54] CONTROL SYSTEM FOR PRESSURE WAVE SUPERCHARGER TO OPTIMIZE EMISSIONS AND PERFORMANCE OF AN INTERNAL COMBUSTION ENGINE

[75] Inventors: Richard W. Kruiswyk; Cho Y. Liang, both of Peoria, Ill.

[73] Assignee: Caterpillar Inc., Peoria, Ill.

[21] Appl. No.: 748,141

[22] Filed: Nov. 12, 1996

[51] Int. Cl.[6] ..... F02B 33/42

[52] U.S. Cl. ..... 123/559.2

[58] Field of Search ..... 60/602; 123/559.2

[56] References Cited

U.S. PATENT DOCUMENTS

| | | | |
|---|---|---|---|
| 4,154,060 | 5/1979 | Deprez et al. | 60/611 |
| 4,232,999 | 11/1980 | Croes et al. | 417/64 |
| 4,288,203 | 9/1981 | Fried et al. | 417/64 |
| 4,517,950 | 5/1985 | Mayer et al. | 123/559.2 |
| 4,529,360 | 7/1985 | Kirchhofer et al. | 417/64 |
| 4,563,997 | 1/1986 | Aoki | 123/550 |
| 4,615,172 | 10/1986 | Mayer | 123/559.2 |
| 4,662,342 | 5/1987 | Altmann et al. | 123/559.2 |
| 4,723,525 | 2/1988 | Fried et al. | 123/559.2 |
| 4,744,213 | 5/1988 | El Nashar | 60/39.45 |
| 4,796,595 | 1/1989 | ElNashar et al. | 123/559.2 |

*Primary Examiner*—Michael Koczo
*Attorney, Agent, or Firm*—F. J. Baehr

[57] ABSTRACT

A control system for an internal combustion engine and an associated pressure wave supercharger, which optimizes exhaust emissions and engine performance by automatically switching the mode of control between a cold start and white smoke mode, an altitude dependent mode, a low emissions mode, a fuel economy mode, and a particulate trap regeneration mode as the operating conditions of the engine change.

10 Claims, 4 Drawing Sheets

Fig. 3

ENGINE SPEED (RPM)

| RACK POSITION (MM) | 700 | 800 | 900 | 1000 | 1100 | 1200 | 1300 | 1400 | 1500 | 1600 | 1700 | 1800 | 1900 | 2000 | 2100 |
|---|---|---|---|---|---|---|---|---|---|---|---|---|---|---|---|
| 1.5 | 0 | 0 | 0 | 0 | 0 | 0 | 0 | 0 | 0 | 0 | 0 | 0 | 0 | 0 | 0 |
| 2 | 77 | 78 | 78 | 75 | 75 | 73 | 68 | 65 | 62 | 60 | 55 | 20 | 20 | 20 | 20 |
| 2.5 | 77 | 77 | 78 | 78 | 75 | 73 | 68 | 65 | 62 | 60 | 55 | 20 | 18 | 17 | 20 |
| 3 | 67 | 68 | 69 | 69 | 67 | 68 | 66 | 64 | 62 | 61 | 59 | 60 | 55 | 50 | 20 |
| 3.5 | 61 | 62 | 62 | 62 | 62 | 62 | 61 | 61 | 61 | 61 | 61 | 60 | 55 | 50 | 24 |
| 4 | 63 | 63 | 63 | 62 | 61 | 61 | 59 | 59 | 58 | 59 | 58 | 58 | 54 | 50 | 40 |
| 4.5 | 62 | 62 | 64 | 63 | 62 | 61 | 60 | 60 | 57 | 58 | 57 | 56 | 53 | 50 | 40 |
| 5 | 58 | 59 | 65 | 65 | 64 | 62 | 60 | 60 | 58 | 57 | 55 | 55 | 53 | 50 | 40 |
| 5.5 | 52 | 54 | 65 | 65 | 63 | 62 | 61 | 59 | 58 | 56 | 55 | 56 | 52 | 50 | 40 |
| 6 | 50 | 48 | 60 | 65 | 63 | 62 | 62 | 61 | 57 | 57 | 56 | 58 | 52 | 50 | 40 |
| 6.5 | 47 | 40 | 56 | 64 | 63 | 62 | 62 | 61 | 57 | 57 | 56 | 56 | 52 | 50 | 40 |
| 7 | 26 | 33 | 44 | 63 | 63 | 62 | 62 | 61 | 59 | 59 | 57 | 57 | 52 | 50 | 39 |
| 7.5 | 20 | 30 | 40 | 51 | 60 | 62 | 61 | 60 | 60 | 59 | 57 | 57 | 52 | 50 | 31 |
| 8 | 4 | 18 | 23 | 34 | 54 | 62 | 61 | 62 | 60 | 69 | 59 | 59 | 54 | 46 | 30 |
| 8.5 | 0 | 7 | 12 | 20 | 40 | 56 | 58 | 60 | 58 | 59 | 58 | 59 | 52 | 42 | 30 |
| 9 | 0 | 0 | 5 | 15 | 25 | 44 | 52 | 54 | 56 | 58 | 57 | 57 | 52 | 40 | 30 |
| 9.5 | 0 | 0 | 0 | 10 | 30 | 40 | 50 | 54 | 55 | 57 | 58 | 56 | 52 | 48 | 27 |
| 10 | 0 | 0 | 0 | 0 | 20 | 40 | 48 | 52 | 54 | 57 | 55 | 54 | 50 | 44 | 22 |
| 10.5 | 0 | 0 | 0 | 0 | 20 | 40 | 45 | 48 | 52 | 55 | 53 | 50 | 46 | 35 | 8.8 |
| 11 | 0 | 0 | 0 | 0 | 0 | 20 | 40 | 45 | 48 | 50 | 48 | 45 | 20 | 0 | 0 |
| 11.5 | 0 | 0 | 0 | 0 | 0 | 0 | 0 | 0 | 0 | 0 | 0 | 0 | 0 | 0 | 0 |

INTAKE RESTRICTOR VALVE ANGLE

FIG. 4

RACK POSITION (MM)

| ENGINE SPEED (RPM) | 2.00 | 2.60 | 3.20 | 3.80 | 4.40 | 5.00 | 5.60 | 6.20 | 6.80 | 7.40 | 8.00 | 8.60 | 9.20 | 9.80 | 10.40 | 11.00 | 11.60 |
|---|---|---|---|---|---|---|---|---|---|---|---|---|---|---|---|---|---|
| 600 | -1.0 | -1.0 | -1.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 650 | -1.0 | -1.0 | -1.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 700 | -1.0 | -1.0 | -1.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 750 | -1.0 | -1.0 | -1.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 800 | -1.0 | -1.0 | -1.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 850 | -3.0 | -3.0 | -3.0 | -3.0 | -5.0 | -5.0 | -5.0 | -5.0 | -5.0 | -5.0 | -5.0 | -5.0 | -4.0 | -3.0 | -2.0 | -1.0 | -1.0 |
| 900 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 950 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1000 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1050 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1100 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1150 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1200 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1250 | -6.0 | -6.0 | -6.0 | -6.0 | -6.0 | -6.0 | -6.0 | -6.0 | -6.0 | -6.0 | -6.0 | -5.0 | -4.0 | -3.0 | -2.0 | -1.0 | -1.0 |
| 1300 | -5.0 | -5.0 | -5.0 | -5.0 | -5.0 | -5.0 | -5.0 | -5.0 | -5.0 | -6.0 | -6.0 | -6.0 | -4.0 | -3.0 | -2.0 | -1.0 | -1.0 |
| 1350 | -3.5 | -3.5 | -3.5 | -3.5 | -3.5 | -3.5 | -3.5 | -3.5 | -3.5 | -6.0 | -6.0 | -6.0 | -4.0 | -3.0 | -2.0 | -1.0 | -1.0 |
| 1400 | -2.0 | -2.0 | -2.0 | -2.0 | -2.0 | -2.0 | -2.0 | -2.0 | -3.0 | -4.0 | -6.0 | -6.0 | -4.0 | -3.0 | -2.0 | -1.0 | -1.0 |
| 1450 | -2.0 | -2.0 | -2.0 | -2.0 | -2.0 | -2.0 | -2.0 | -2.0 | -3.0 | -4.0 | -6.0 | -6.0 | -4.0 | -3.0 | -2.0 | -1.0 | -1.0 |
| 1500 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1550 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1600 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1650 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1700 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1750 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1800 | -2.0 | -2.0 | -2.0 | -2.0 | -2.0 | -2.0 | -2.0 | -2.0 | -3.0 | -4.0 | -6.0 | -6.0 | -5.0 | -4.0 | -3.0 | -2.0 | -2.0 |
| 1850 | -2.0 | -2.0 | -2.0 | -2.0 | -2.0 | -2.0 | -2.0 | -2.0 | -3.0 | -4.0 | -5.0 | -5.0 | -5.0 | -4.0 | -3.0 | -2.0 | -2.0 |
| 1900 | -2.0 | -2.0 | -2.0 | -2.0 | -2.0 | -2.0 | -2.0 | -2.0 | -3.0 | -4.0 | -5.0 | -5.0 | -5.0 | -4.0 | -3.0 | -2.0 | -2.0 |
| 1950 | -2.0 | -2.0 | -2.0 | -2.0 | -2.0 | -2.0 | -2.0 | -2.0 | -3.0 | -4.0 | -5.0 | -5.0 | -4.0 | -4.0 | -3.0 | -2.0 | -2.0 |
| 2000 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2050 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2100 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2150 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2200 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2250 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2300 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |
| 2350 | -2.0 | -2.0 | -2.0 | -2.0 | -2.0 | -2.0 | -2.0 | -2.0 | -3.0 | -4.0 | -5.0 | -5.0 | -4.0 | -3.0 | -2.0 | -1.0 | -1.0 |

INJECTION TIMING (DEGREES)

CONTROL SYSTEM FOR PRESSURE WAVE SUPERCHARGER TO OPTIMIZE EMISSIONS AND PERFORMANCE OF AN INTERNAL COMBUSTION ENGINE

TECHNICAL FIELD

The invention relates to a control system for a pressure wave supercharger and more particularly to a multi-mode control system for a pressure wave supercharger that optimizes exhaust emissions and performance of an internal combustion engine in each mode of operation.

BACKGROUND ART

Pressure wave superchargers for internal combustion engines, particularly diesel engines, are adapted to utilize the exhaust gases from the engine to produce a pressure wave that compresses combustion air in a plurality of elongated chambers disposed in a circular array, which is adapted to be rotated about a central axis by a variable speed motor. Low pressure combustion air enters one end of the rotating elongated chambers. High pressure exhaust gases enter the other end of the rotating elongated chambers producing a pressure wave within the elongated chambers which compresses the combustion air and as the chambers rotate about their central axis the compressed combustion air is discharged from the same end of the elongated chamber that it entered. The compressed combustion air is supplied to an intake manifold of the internal combustion engine. As the elongated chambers rotate the exhaust gas at a lower pressure leaves the same end of the elongated chamber that it entered and is discharged to the atmosphere. An important requirement of today's internal combustion engines is that they operate to minimize undesirable exhaust emissions and yet operate efficiently.

SUMMARY OF THE INVENTION

Among the objects of the invention may be noted the provision of a control system for a pressure wave supercharger for an internal combustion engine that will provide low exhaust emissions and optimum performance in all modes of operation from cold startup through its required speed and load changes and at various altitudes.

In general, a control system for an internal combustion engine, when made in accordance with this invention, comprises an internal combustion engine having a liquid coolant, an intake manifold for supplying combustion air to the engine, an exhaust manifold for the high pressure exhaust gases and a fuel injection system which is adapted to vary the timing of the fuel injection and a pressure wave supercharger having a circular array of elongated chambers disposed to rotate about a central axis, and a variable speed drive to rotate the circular array of elongated chambers at various speeds. A low pressure combustion air duct and a high pressure combustion air duct are each disposed in fluid communication with the same end of a plurality of different elongated chambers. A high pressure exhaust duct and a low pressure exhaust duct are each disposed in fluid communication with the other end of a plurality of different elongated chambers. Disposed between the high pressure exhaust duct and the low pressure exhaust ducts and in fluid communication with the other end of a plurality of elongated chambers is a gas pocket. The gas pocket is also disposed in fluid communication with the high pressure exhaust duct through a flow control valve. The high pressure exhaust duct is also disposed in fluid communication with the exhaust manifold. The low pressure exhaust duct is disposed in fluid communication with the atmosphere and has a restrictor valve disposed therein. The high pressure combustion air duct is disposed in fluid communication with the intake manifold. The low pressure combustion air duct is disposed in fluid communication with the atmosphere and has a restrictor valve disposed therein. The control system is characterized in that, the control system automatically switches from one mode of operation to another in response to varying operating conditions and emissions requirements utilizing a plurality of maps based on fixed data points obtained from empirical data specific to the internal combustion engine, the pressure wave supercharger and the particular mode in which the engine is operating to optimize engine performance and control emissions within the required limits.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

FIG. 3 is a typical map or table of empirical data points specific to the operation of a particular engine and pressure wave supercharger showing the relationship between engine speed, rack position and the angle of the intake restrictor valve utilized by the controller to adjust the intake restrictor valve, which the controller cooperatively associates with other tables or maps to optimize engine performance and emissions.

FIG. 4 is a typical map table of empirical data points specific to the operation of a particular engine and pressure wave supercharger showing the relationship between engine speed , rack position and the timing of the fuel injection utilized by the controller to adjust the timing of the fuel injection which the controller cooperatively associates with other tables or maps to optimize engine performance and emissions.

DESCRIPTION OF THE PREFERRED EMBODIMENT

Figure 1:
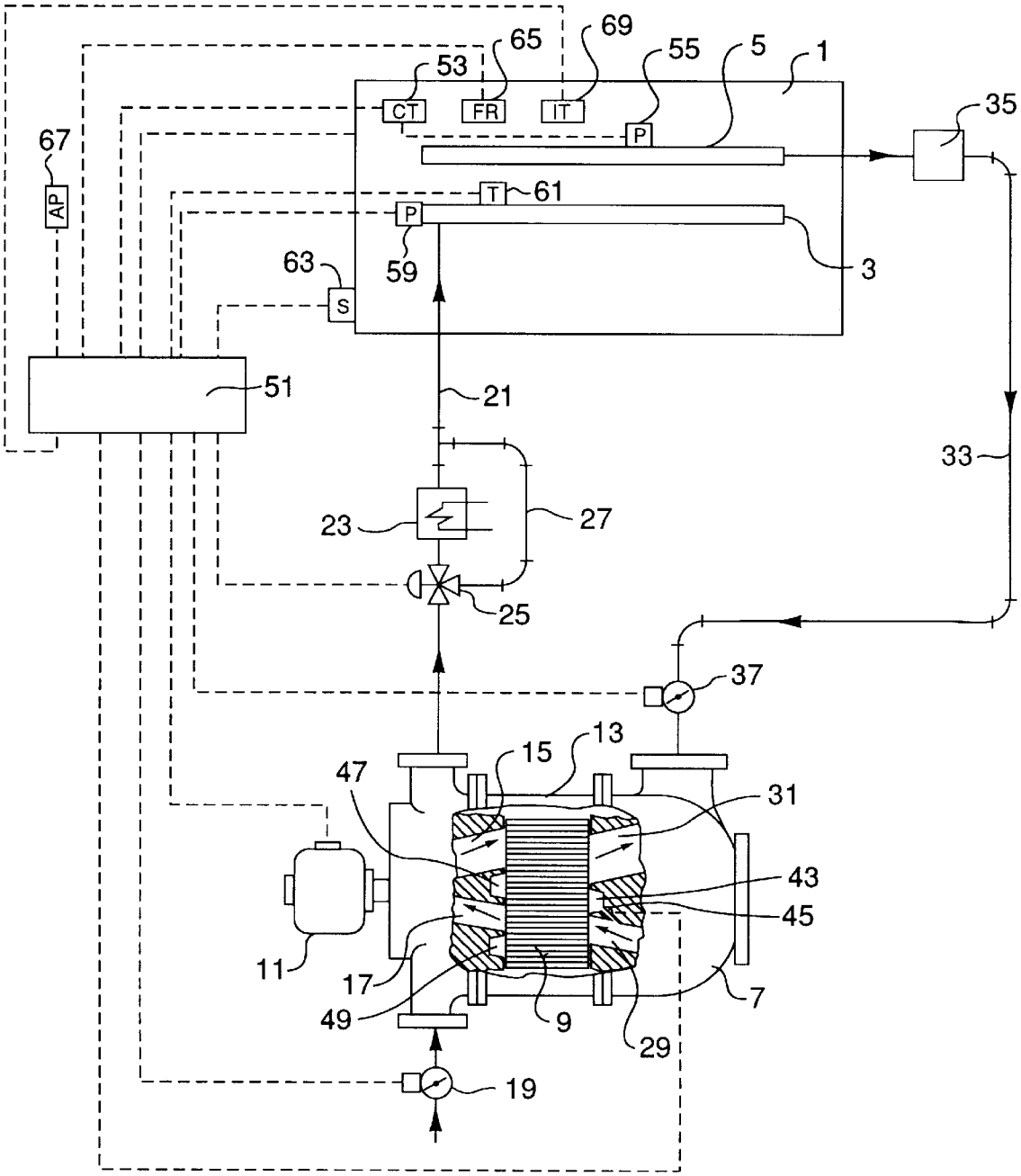
FIG. 1 is a schematic view of an internal combustion engine having a pressure wave supercharger and a control system made in accordance with this invention.

Referring now to the drawings in detail and in particular to FIG. 1 there is shown an internal combustion engine 1 comprising a intake manifold 3, an exhaust manifold 5 and a pressure wave supercharger 7.

The pressure wave supercharger 7 comprises a circular array of elongated chambers 9 disposed to form a rotor which is rotated at controlled speeds about a central axis by a variable speed motor 11. The circular array of elongated chambers 9 are enclosed within a housing 13.

At opposite ends of the rotor housing 13 are an air housing structure and a gas housing structure. The air housing structure contains a low pressure combustion air duct 15 and a high pressure combustion air duct 17 which ducts are separated from and maintained out of fluid communication with one another. Each of the combustion air ducts 15 and 17 are disposed in fluid communication with one end of a plurality of different elongated chambers 9. The low pressure combustion air duct 15 is disposed in fluid communication with the atmosphere and has an intake butterfly or restrictor valve 19 disposed therein. The high pressure combustion air duct 17 is disposed in fluid communication with the intake manifold 3 via a combustion air conduit 21. An aftercooler 23 is disposed in the combustion air conduit 21. An aftercooler bypass valve 25 and aftercooler bypass conduit 27 disposed to direct the high pressure combustion air through the aftercooler 23 or through the aftercooler bypass conduit 27 depending on the desired temperature of the high pressure combustion air entering the intake manifold.

The gas housing structure contains a high pressure exhaust duct 29 and a low pressure exhaust duct 31 which ducts are separated from and maintained out of fluid communication with one another. Each of the exhaust ducts 29 and 31 are disposed in fluid communication with another end of a plurality of different elongated chambers 9. The high pressure exhaust duct 29 is disposed in fluid communication with the exhaust manifold 5 via an exhaust conduit 33. The exhaust conduit 33 has a particulate trap 35 disposed therein. An exhaust butterfly or restrictor valve 37 is also disposed in the exhaust conduit 33 down stream of the particulate trap 35. The low pressure exhaust duct 31 is disposed in fluid communication with the atmosphere.

Figure 2:
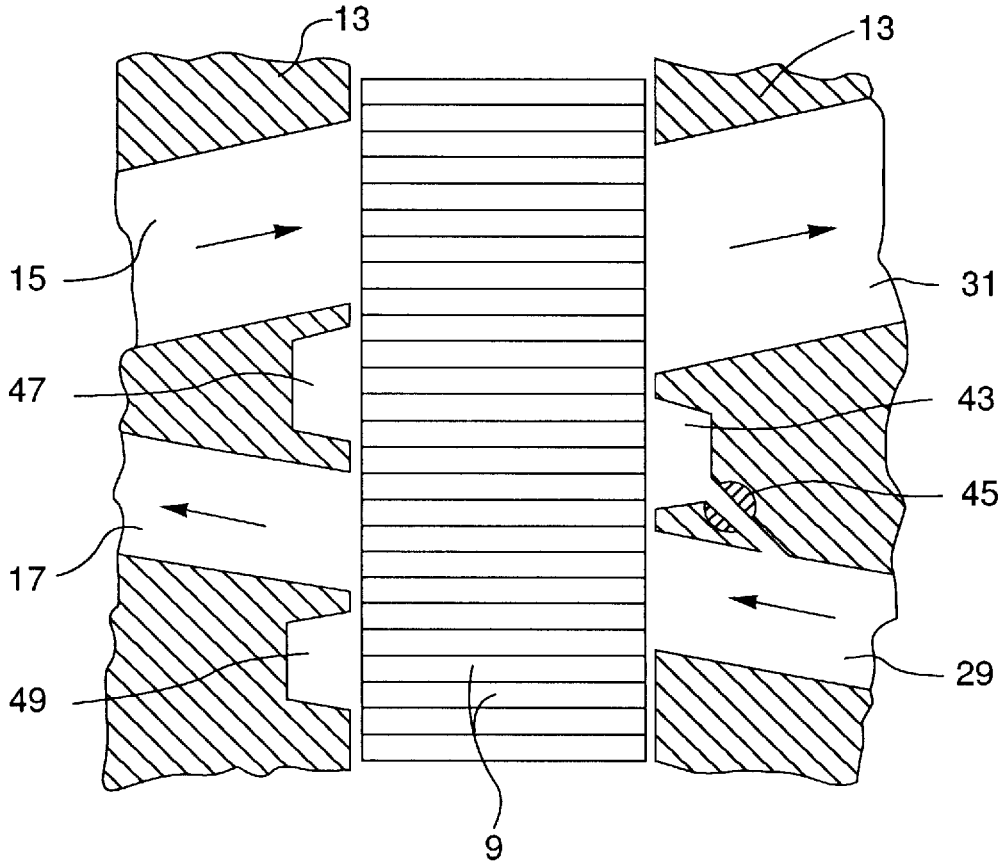
FIG. 2 is an enlarged partial sectional view of a plurality of elongated chambers and ducts and pockets which form the pressure wave supercharger.

As show in FIG. 1 and more clearly in FIG. 2 the pressure wave supercharger also comprises a gas pocket 43 disposed between the high pressure exhaust duct 29 and the low pressure exhaust duct 31 and in fluid communication with the other end of a plurality of the elongated chambers 9 and with the high pressure exhaust duct 29 through a flow control valve 45. An expansion pocket 47 is disposed between the low pressure combustion air duct 15 and the high pressure combustion air duct 17 and in fluid communication with the one end of a plurality of elongated chambers 9. A compression pocket 49 is disposed adjacent the lower side of the of the high pressure combustion air duct 17 and in fluid communication with the one end of a plurality of elongated chambers 9.

Referring again to FIG. 1 there is shown an electronic controller or control system 51 for the engine and pressure wave supercharger. The controller 51, is connected to and receives signals from a plurality of sensors including an engine coolant temperature sensor 53, an exhaust manifold pressure sensor 55, an intake manifold pressure sensor 59, an intake manifold temperature sensor 61, an engine speed sensor 63, a fuel rate sensor 65, and an ambient air pressure or atmospheric pressure sensor 67. The controller 51 is also connected to, senses and controls or adjusts the speed of the variable speed motor 11, and is connected to, senses and controls or adjusts the position of the gas pocket flow control valve 45, the intake restrictor valve 19, the aftercooler bypass valve 25, the exhaust restrictor valve 37 and a fuel injection timing device 69 disposed within the engine 1.

FIG. 3 is a typical map or table of empirical data points specific to the operation of a particular engine 1 and pressure wave supercharger 7 showing the relationship between engine speed, rack position and the angle of the intake restrictor valve 19. This map or table is utilized by the controller 51 to adjust the intake restrictor valve 19, which the controller 51 utilizes in cooperation with other tables to optimize engine performance and emissions.

FIG. 4 is a typical map table of empirical data points specific to the operation of a particular engine 1 and pressure wave supercharger 7 showing the relationship between engine speed, rack position and the timing of the fuel injection utilized by the controller 51 to adjust the timing of the fuel injection which the controller 51 utilizes in cooperation with other tables or maps to optimize engine performance and emissions.

The controller 51 automatically switches modes of operation to optimize engine performance and control emissions depending on operating criteria and emission requirements utilizing a plurality of maps or tables based on fixed data points obtained from empirical data specific to the engine 1 and pressure wave supercharger 7 and the particular mode of engine operation. Typical maps or tables of such data points are shown in FIGS. 3 and 4. Each mode of operation requires particular maps or tables developed by running the engine 1 and pressure wave supercharger 7 on a test stand to determine the optimum engine performance while maintaining the emissions within the required limits. For example, the engine speed verses fuel rate or rack position compared to injection timing is utilized in multiple modes, however, each mode would have a specific table developed empirically. While several of the data points many be close, the requirements of the individual modes are so different that the maps or tables of the same variables would be different. The controller 51 can automatically switch between a plurality of modes which comprises a cold start and white smoke mode, an altitude dependent mode, a low emissions mode, a fuel economy mode, and a particulate trap regeneration mode.

The controller 51 will select the cold start and white smoke mode when the engine coolant temperature is below a predetermined level. When the ambient or atmospheric pressure are below a predetermined absolute pressure the controller 51 will initiate a high altitude mode. When the rate of change of the fuel rate is above a predetermined level the controller 51 will activate the low emissions mode. On the other hand, when the rate of change of the fuel rate is below a predetermined level the controller 51 will activate the fuel economy mode and when the exhaust manifold pressure rises to a predetermined level the controller 51 will activate the particulate trap regeneration mode.

In the cold start and white smoke mode the controller 51 opens the intake or combustion air restrictor valve 19 to its fully open position, it also adjusts the speed of the variable speed drive or motor 11, it adjusts the position of the gas pocket control valve 45 and adjusts the position of the exhaust restrictor valve 37 to conform to specific data points on the associated maps or tables or the controller 51 will interpolate between data points in order to provide optimum exhaust gas recirculation, to aid starting and engine warm-up and white smoke cleanup.

When the atmospheric or ambient pressure sensor 67 indicates the atmospheric pressure is below a predetermined level the controller 51 switches to the high altitude mode and begins to operate on the maps or tables, which are based on empirical data points specific to this mode of operate and the particular engine 1 and pressure wave supercharger 7, by advancing the fuel injection timing, to minimize the exhaust temperature rise associated with operating at higher elevations or lower atmospheric pressure. The variable speed drive 11 and gas pocket flow control valve 45 are adjusted to increase the boost pressure or the pressure of the high pressure combustion air fed to the intake manifold 3 in accordance with the empirical data points specific to this mode of operation.

When the rate of change of the fuel rate is above a predetermined level the controller 51 switches to the low emissions mode, which utilizes a specific set of maps or tables to adjust the variable speed drive 11 and the gas pocket flow control valve 45 to optimize the boost or high pressure combustion air to reduce or lower the particulate emission. The controller 51 also adjusts the fuel injection timing device 69 to lower NOx emissions and may also adjust the intake restrictor valve 19 to control exhaust gas recirculation to provide further NOx reduction, if necessary, in accordance with the empirical data points specific to this mode of operation.

When the engine load is below a predetermined level at any given engine speed, the after cooler bypass valve 25 operates to direct air and exhaust gas recirculation mixture to bypass the aftercooler 23. This decreases hydrocarbon emissions and reduces fouling of the aftercooler 23 by exhaust gas recirculation.

When the rate of change of the fuel rate is below a predetermined level, the intake and exhaust restrictor valves 19 and 37 are advanced to their wide open positions to minimize pressure drops and reduce pumping work of the engine 1 and the gas pocket valve 45 and variable speed drive 11 are adjusted to optimize the overall efficiency of pressure wave supercharger 7 and the fuel injection timing device 11 is adjusted to provide the lowest fuel consumption, in accordance with the empirical data points specific to this mode of engine operation.

When the exhaust manifold pressure reaches a predetermined level the controller 51 switches to a particulate trap regeneration mode and another set of maps or tables and retards the injection timing to increase the exhaust temperature. If the exhaust manifold pressure is not reduced, the controller 51 adjusts the variable speed drive 11, the gas pocket flow control valve 45 and the exhaust restrictor valve 37 to further increase the exhaust temperature and burn the particulate material or soot in the particulate trap. This mode would only be utilized briefly, just long enough to burn the soot.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The pressure wave supercharger is particularly applicable to diesel engines which are utilized to power motor vehicles as the pressure wave supercharger has extremely fast response time and providing a controller which will keep the emissions within regulatory limits and optimize performance of the engine as it goes through various modes of operation makes the system economically viable.

What is claimed is:

1. A control system for an internal combustion engine having a liquid coolant, an intake manifold for supplying combustion air to the engine, an exhaust manifold for the high pressure exhaust gases and a fuel injection system which is adapted to vary the timing of the fuel injection and a pressure wave supercharger having a circular array of elongated chambers disposed to rotate about a central axis, a variable speed drive to rotate the circular array of elongated chambers, a low pressure combustion air duct and a high pressure combustion air duct each disposed in fluid communication with the same end of a plurality of different elongated chambers, a high pressure exhaust duct and a low pressure exhaust duct each disposed in fluid communication with the other end of a plurality of different elongated chambers, disposed between the high pressure exhaust duct and the low pressure exhaust ducts and in fluid communication with the other end of a plurality of elongated chambers is a gas pocket, the gas pocket is also in fluid communication with the high pressure exhaust duct through a flow control valve, the high pressure exhaust duct is disposed in fluid communication with the exhaust manifold via an exhaust conduit, which has a restrictor valve disposed therein, and the low pressure exhaust duct is disposed in fluid communication with the atmosphere, the high pressure combustion air duct is disposed in fluid communication with the intake manifold and the low pressure combustion air duct is disposed in fluid communication with the atmosphere and has a restrictor valve disposed therein; the control system being characterized in that, the control system automatically switches from one mode of operation to another in response to varying operating conditions and emissions requirements utilizing a plurality of maps based on fixed data points obtained from empirical data specific to the engine and pressure wave supercharger and the particular mode of engine operation to optimize engine performance and control emissions.

2. A control system for an internal combustion engine as set forth in claim 1 characterized in that the modes of operation of the control system comprise a cold start and white smoke mode, an altitude dependent mode, and a low emissions mode.

3. A control system for an internal combustion engine as set forth in claim 2 further comprising a particulate trap disposed in the exhaust conduit and characterized in that the modes of operation of the control system further comprises a fuel economy mode and a particulate trap regeneration mode.

4. A control system for an internal combustion engine as set forth in claim 2 characterized in that when the liquid coolant temperature is below a predetermined value, the control system operates on one set of maps based on fixed data points obtained from empirical data specific to the engine and pressure wave supercharger to heat the engine rapidly and minimize white smoke, when the atmospheric pressure is below a predetermined level, the control system switches to operate on another set of maps based on fixed data points obtained from empirical data specific to the engine and pressure wave supercharger to increase the pressure of the high pressure combustion air and minimize the exhaust temperature, and when the rate of change of the fuel rate is above a predetermined level, the control system switches to operate on another set of maps based on fixed data points obtained from empirical data specific to the engine and pressure wave supercharger to optimize hydrocarbon and NOx emissions, thereby optimizing the engines performance and controlling emissions as the engine operates in different modes.

5. A control system for an internal combustion engine as set forth in claim 3 characterized in that the rate of change of the fuel rate is below a predetermined level, the control system switches to another set of maps based on fixed data points obtained from empirical data specific to the engine and pressure wave supercharger to provide the lowest fuel consumption and when the pressure in the exhaust manifold reaches a predetermined level the control system switches to another set of maps based on fixed data points obtained from empirical data specific to the engine and pressure wave supercharger to increase the exhaust temperature to burn off accumulated soot and regenerate the particulate trap.

6. A control system for an internal combustion engine as set forth in claim 2 further characterized in that when the liquid coolant is below a predetermined temperature the control system opens the combustion air restrictor valve to its fully open position, the variable speed drive, the gas pocket valve and the exhaust restrictor valve are adjusted to provide optimum exhaust gas recirculation to aid starting, engine warm-up and white smoke cleanup in accordance with the empirical data points specific to this mode of engine operation.

7. A control system for an internal combustion engine as set forth in claim 6 further characterized in that when the atmospheric pressure is below a predetermined level the fuel injection timing is advanced to minimize exhaust temperature with lower atmospheric pressure, the variable speed drive and gas pocket valve are adjusted to increase the pressure of the high pressure combustion air in accordance with the empirical data points specific to this mode of engine operation.

8. A control system for an internal combustion engine as set forth in claim 7 further characterized in that when the rate of change of the fuel rate is above a predetermined level, the variable speed drive and the gas pocket valve are adjusted to optimize the pressure of the high pressure combustion air for low particulate emission, the fuel injection timing device is adjusted for low NOx emissions and the intake restrictor valve is adjusted to control exhaust gas recirculation to provide further NOx reduction, if necessary, in accordance with the empirical data points specific to this mode of engine operation.

9. A control system for an internal combustion engine as set forth in claim 3 further characterized in that when the rate of change of the fuel rate is below a predetermined level, the intake and exhaust valves are advanced to wide open to minimize pressure drops and reduce pumping work of the engine and the gas pocket valve and variable speed drive are adjusted to optimize the overall efficiency of pressure wave supercharger and the fuel injection timing device is adjusted to provide the lowest fuel consumption, in accordance with the empirical data points specific to this mode of engine operation.

10. A control system for an internal combustion engine as set forth in claim 9 further comprising a particulate trap disposed in the exhaust conduit and characterized in that when the exhaust manifold pressure reaches a predetermined level the fuel injection timing is retarded to increase the exhaust temperature to regenerate the particulate trap by burning off accumulated soot, if the exhaust manifold has not dropped below the predetermined level, the variable speed drive, the gas pocket valve and the exhaust restrictor valve are adjusted to increase exhaust gas recirculation to further increase the exhaust temperature to regenerate the particulate trap by burning off the remaining soot.

* * * * *

UNITED STATES PATENT AND TRADEMARK OFFICE

CERTIFICATE OF CORRECTION

PATENT NO. : 5,839,416

DATED : November 24, 1998

INVENTOR(S) : Richard W. Kruiswyk, et al.

It is certified that error appears in the above-identified patent and that said Letters Patent is hereby corrected as shown below:

On the title page, item [54], —should read as follows —

CONTRÓL SYSTEM FOR PRESSURE WAVE SUPERCHARGER TO OPTIMIZE EXHAUST EMISSIONS AND PERFORMANCE OF AN INTERNAL COMBUSTION ENGINE

Col.1, line 2, the title of the Patent to read as follows:

CONTROL SYSTEM FOR PRESSURE WAVE SUPERCHARGER TO OPTIMIZE EXHAUST EMISSIONS AND PERFORMANCE OF AN INTERNAL COMBUSTION ENGINE

Signed and Sealed this

Twenty-ninth Day of June, 1999

*Attest:*

Q. TODD DICKINSON

*Attesting Officer*

*Acting Commissioner of Patents and Trademarks*